US007198101B2

(12) United States Patent
McGarian et al.

(10) Patent No.: US 7,198,101 B2
(45) Date of Patent: Apr. 3, 2007

(54) DOWNHOLE RELEASE JOINT

(75) Inventors: Bruce McGarian, Aberdeen (GB); Ian Alexander Gillies, Angus (GB)

(73) Assignee: Smith International, Inc., Houston, TX (US)

( * ) Notice: Subject to any disclaimer, the term of this patent is extended or adjusted under 35 U.S.C. 154(b) by 123 days.

(21) Appl. No.: 10/484,636

(22) PCT Filed: Jul. 30, 2002

(86) PCT No.: PCT/GB02/03473

§ 371 (c)(1),
(2), (4) Date: May 25, 2004

(87) PCT Pub. No.: WO03/012245

PCT Pub. Date: Feb. 13, 2003

(65) Prior Publication Data

US 2004/0188086 A1 Sep. 30, 2004

(30) Foreign Application Priority Data

Jul. 30, 2001 (GB) ..... 0118547.9

(51) Int. Cl.
*E21B 17/06* (2006.01)

(52) U.S. Cl. ..... 166/242.6; 166/377; 166/117; 175/256

(58) Field of Classification Search ..... 166/242.6, 166/377, 117; 175/256, 320
See application file for complete search history.

(56) References Cited

U.S. PATENT DOCUMENTS 2,307,275 A * 1/1943 Johnson ..... 285/36
3,387,863 A 6/1968 Treese
3,667,252 A 6/1972 Nelson
3,895,829 A * 7/1975 Manson, Jr. ..... 285/3
5,146,984 A * 9/1992 Pleasants ..... 166/238
5,158,142 A * 10/1992 Miszewski et al. ..... 166/377
5,363,921 A * 11/1994 Mendez ..... 166/377
5,568,836 A * 10/1996 Reid ..... 166/65.1
6,279,962 B1 * 8/2001 McGarian et al. ..... 285/12
6,712,146 B2 * 3/2004 Estep et al. ..... 166/377
6,834,889 B2 * 12/2004 Sunde et al. ..... 285/92

FOREIGN PATENT DOCUMENTS

| | | |
|---|---|---|
| EP | 0286373 | 10/1988 |
| EP | 0458289 | 11/1991 |
| GB | 2123523 | 2/1984 |
| GB | 2287731 | 9/1995 |
| WO | 9813576 | 4/1998 |
| WO | 9830823 | 7/1998 |
| WO | 0149967 | 7/2001 |

* cited by examiner

*Primary Examiner*—Nicole A Coy
(74) *Attorney, Agent, or Firm*—Dykema Gossett PLLC

(57) ABSTRACT

A downhole apparatus permitting separation of one part of downhole equipment from another part thereof includes a first part connected to a second part by a connecting member which limits axial and rotational movement of the first and second parts and has first and second ends connected respectively to the first and second parts. The connecting member includes a cross bar extending between the first and second ends having an aperture therein that results in a region of weakness, a portion of the cross bar spaced from the aperture minimizing stress at the region of weakness when torque is transmitted in use between the first and second parts via the connecting member.

14 Claims, 2 Drawing Sheets

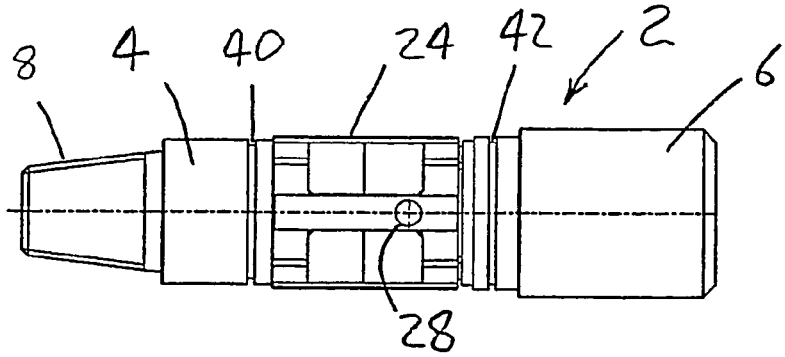
FIG. 1
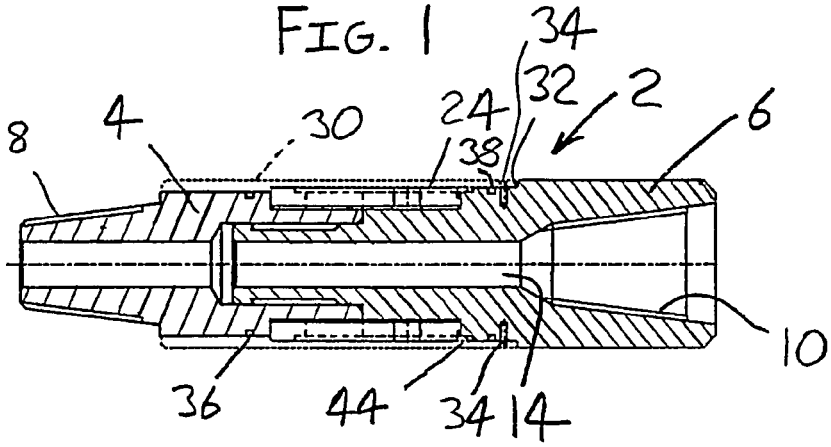
FIG. 2
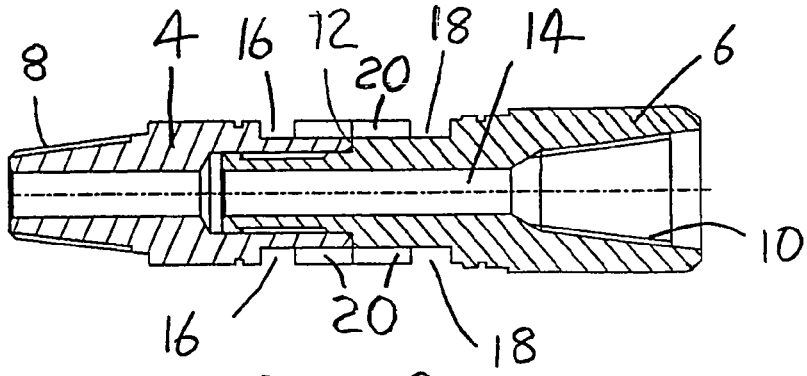
FIG. 3
FIG. 4
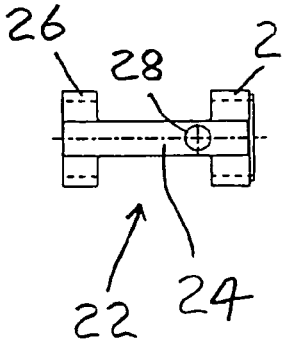
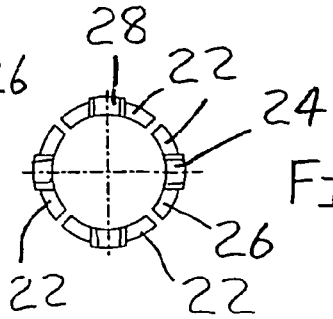
FIG. 5

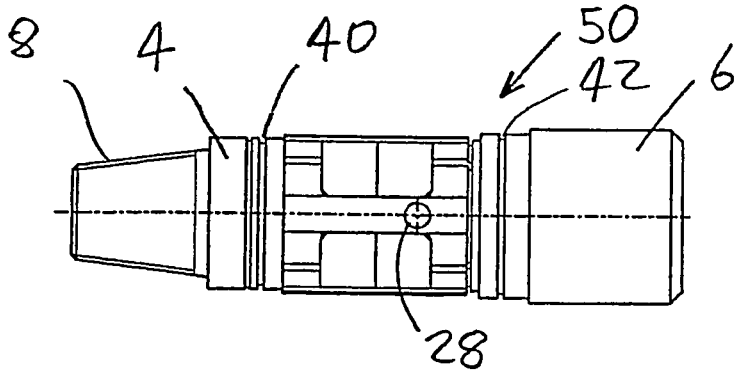
FIG. 6
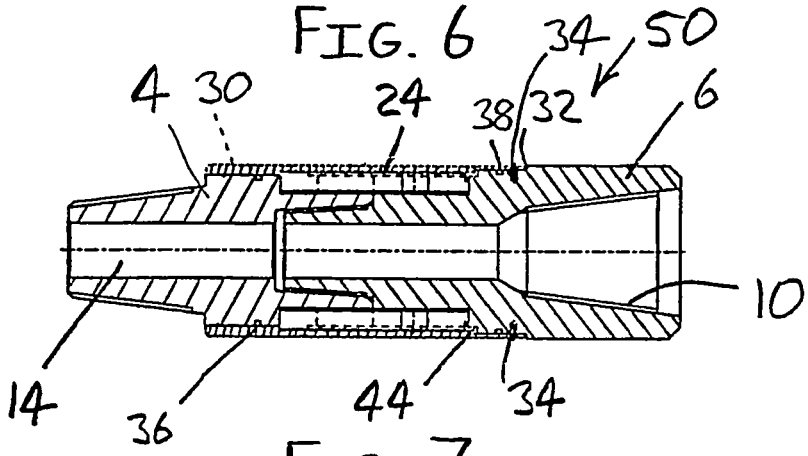
FIG. 7
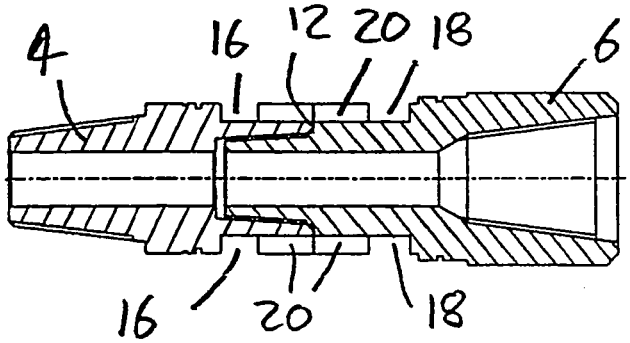
FIG. 8
FIG. 9
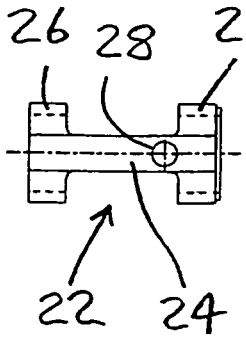
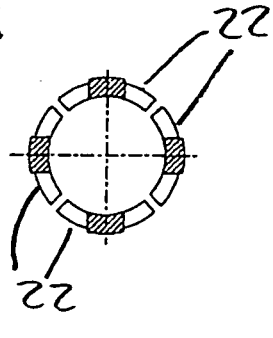
FIG. 10

DOWNHOLE RELEASE JOINT

BACKGROUND OF THE INVENTION

1. Field of the Invention

The present invention relates to downhole apparatus permitting separation of one part of downhole equipment from another part thereof.

2. The Prior Art

It is not uncommon for a drill bit to become stuck inhole during downhole oil and gas drilling operations. In order to allow retrieval of a downhole drill string when a drill bit becomes jammed, it is known to provide a drill string with an emergency release joint immediately uphole of the drill bit. During normal operation, the release joint transmits torque from a motor to the drill bit. However, in the event that the drill bit becomes jammed to the extent that axial and rotational movement of the drill bit is not possible, the drill bit may be separated from the remainder of the drill string by virtue of the release joint. The remainder of the drill string may then be moved axially uphole so that specialist retrieving equipment may be run to the drill bit in a fishing operation.

Although the prior art release joints are effective in providing a mechanism for releasing the drill bit from the remainder of the drill string, the prior art devices are unduly complicated in design.

It is an object of the present invention to provide apparatus allowing the release of one part of equipment from another part thereof, wherein said apparatus is of a relatively simple design and relatively inexpensive to manufacture.

SUMMARY OF THE INVENTION

The present invention provides downhole apparatus comprising a first part connected to a second part by connecting means, the connecting means limiting axial and rotational movement of the first part relative to the second part and comprising a connecting member having a first end connected to said first part so as to limit axial and rotational movement of said first part relative to said first end and having a second end connected to said second part so as to limit axial and rotational movement of said second part relative to said second end, wherein the connecting member is provided between said first and second ends with a region of weakness in the connecting member provided by weakening means, and with means for minimising stress generated in the connecting means at said region of weakness when torque is transmitted in use between the first and second parts via the connecting member.

Thus, in use of downhole apparatus according to the present invention, the first part of the apparatus may be connected to a drill bit and a second part of the apparatus may be connected to a motor. Since the connection between the first and second parts is such as to limit axial and rotational movement of said parts relative to one another, the drill bit may be suspended from the motor by means of the apparatus as the drill bit is run downhole. Furthermore, torque may be transmitted from the motor to the drill bit via the apparatus during a drilling operation. In the event that the drill bit becomes jammed and rotational or axial movement of the remaining drill string is prevented, the drill string may be place in tension so that the connecting member breaks at said region of weakness. Although the drill bit remains jammed inhole, the remainder of the drill string may then be retrieved. The region of weakness is such that the drill bit may be released without the need to place the drill string under excessive tension. However, the region of weakness is not so weak that normal axial movement of the drill string cannot be undertaken without release of the drill bit. Despite the region of weakness in the connecting member, the apparatus of the present invention is capable of transmitting the high torques associated with drilling operations due to the means for minimising stress generated in the connecting member at the region of weakness.

It is preferable for the connecting member to comprise an axially projecting portion extending from said first end to said second end. At least one of said ends of the connecting member is provided with hook means for hooking about one of said first and second parts so as to allow a transmission of tension between said one part and the connecting member. The hook means may comprise a portion extending perpendicularly to the axially projecting portion. Said perpendicularly extending portion may extend circumferentially about he longitudinal axis of the apparatus. Each end of said axially projecting portion of the connecting member may be provided with hook means. The or each hook means may be located adjacent a shoulder provided in one of the first and second parts. Preferably, the connecting member is of an H-shape wherein the cross member of the H-shape is the axially projecting portion.

It is further preferable for the weakening means to be a reduction in cross-sectional area of said axially projecting portion of the connecting member. Ideally, the weakening means is an aperture provided in the axially projecting portion. The connecting means may comprise a plurality of connecting members as described above. It is preferable for the connecting means to comprise four of said connecting members.

Furthermore, said means for minimising stress generated in the connecting member at said region of weakness comprises a shoulder defined by one of said parts, wherein the shoulder comprises an axially extending surface for abutting the connecting member in said region of weakness during transmission of torque through said apparatus when in use. The axially extending surface of said shoulder preferably abuts the connecting member in a region remote from the region of weakness.

Embodiments of the present invention will now be described with reference to the accompanying drawings.

BRIEF DESCRIPTION OF THE DRAWINGS

FIG. 1 is a side view of a first embodiment of the present invention (shown without a cover sleeve);

FIG. 2 is a cross-sectional side view of the embodiment shown in FIG. 1 (shown with a cover sleeve secured in position);

FIG. 3 is a cross-sectional side view of first and second parts of the first embodiment;

FIG. 4 is a plan view of a connecting member of the first embodiment;

FIG. 5 is an end view of four of the connecting members of FIG. 4 arranged in a circular configuration as shown in FIGS. 1 and 2;

FIG. 6 is a side view of a second embodiment of the present invention (shown without a cover sleeve);

FIG. 7 is a cross-sectional side view of the embodiment shown in FIG. 1 (shown with a cover sleeve secured in position);

FIG. 8 is a cross-sectional side view of first and second parts of the second embodiment;

FIG. 9 is a plan view of a connecting member of the second embodiment; and

FIG. 10 is an end view of four of the connecting members of FIG. 4 arranged in a circular configuration as shown in FIGS. 1 and 2.

DETAILED DESCRIPTION OF THE PREFERRED EMBODIMENTS

A first downhole release joint 2 is shown in FIGS. 1 and 2 of the accompanying drawings. The release joint 2 comprises first and second parts 4,6 which are each of a generally cylindrical shape of approximately the same external diameter. The first part 4 has an external screw thread 8 for engagement with downhole equipment such as a motor and the second part 6 has an internal screw thread 10 for engagement with downhole equipment such as a drill bit. The end of the second part 6 distal to the internal screw thread 10 has a reduced external diameter which locates within the end of the first part 4 distal to the external screw thread 8. The first part 4 abuts an annular external shoulder 12 defined on the external surface of the second part 6. The two parts 4,6 of the release joint 2 locate in abutment with one another so as to define a substantially cylindrical assembly having an axially projecting bore extending therethrough.

The external surface of each part 4,6 is provided with a circumferentially extending slot 16,18 (see FIG. 3 in particular) and four equi-spaced and axially projecting slots 20 extending from said circumferentially projecting slots 16,18. As can be seen in FIGS. 1 to 3, the axially projecting slots 20 are arranged so that, when the first and second parts 4,6 are engaged in abutment with another, said axial slots 20 of one part 4 align with those axial slots 20 of the other part 6 so as to define a total of four axially projecting slots extending between the circumferentially projecting slots 16,18.

The two parts 4,6 of the release joint 2 are retained in abutment with one another by means of four identical connecting members 22 (see FIG. 4). Each connecting member 33 is of an H-shape and sized to locate in the circumferentially and axially projecting slots 16,18,20. The cross bar 24 of the H-shape locates in a pair of aligned axially projecting slots 20. The portions 26 of connecting member 22 either end of the cross bar 24 have a curved part cylindrical shape (as most clearly seen in FIG. 5) for locating in the circumferentailly projecting slots 16,18. It will be seen by reference FIG. 1 in particular that the relative dimensions of the connecting members 22 and circumferetially/axially projecting slots 16,18,20 is such that, with the connecting members 22 located in said slots, relative axial and rotational movement between the first and second parts 4,6 is minimal. In this regard, it is preferable for the cross bar 24 to locate within aligned axial slots 20 with an interference fit. In this way, relative rotation between the first and second parts 4,6 is reduced to a minimum. Similarly, the length of each pair of aligned axial slots 20 relative to the distance between end portions 26 of an associated connecting member 22 is such that said end portions locate within the circumferetially projecting slots 16,18 with an interference fit. In this way, relative axial movement of the first and second part, is reduced to a minimum.

The cross bar 24 is provided with an aperture 28 through the thickness thereof. The aperture 28 is provided between the end portions 26. In the assembled release joint 2, the aperture 26 locates in a region of axially projecting slot 20 defined by one only of said parts 4,6. The aperture 28 does not span the two parts 4,6.

With reference to FIGS. 1 and 5, it will be seen that the cross bar 24 of each connecting member 22 is upstanding for reception within an axially extending groove defined on the interior surface of a cover sleeve 30 (shown in FIG. 2). The cover sleeve 30 is a cylindrical member having an external diameter substantially equal to the external diameter of the portion of the second part 6 located adjacent the internal thread 10. The cover sleeve 30 locates in abutment with an external shoulder 32 provided on the exterior surface of the second part 6. The cover sleeve 30 is retained in position by means of four equi-spaced screws 34 (only two of which are visible in FIG. 2). Prevention of rotational movement of the cover sleeve relative to the first and second parts 4,6 is further assisted by the reception of the upstanding cross bars 24 of the connecting members 22 within the aforementioned internal cover sleeve grooves. If required, the external surface of the cover sleeve 30 may be provided with blades and/or stabiliser fins. A fluid seal between the cover sleeve 30 and the first and second parts 4,6 is ensured by means of two O-ring seals 36,38. These O-ring seals 36,38 locate in circumferential grooves 40,42 defined in the first and second parts 4,6 respectively. Adequate retention of the connecting members 22 is also assisted by means of a circlip 44.

During use, the external thread 8 may be used for engagement with a motor and the internal screw thread 10 may be used for engagement with a drill bit. Thus, as the drill bit is run downhole, the weight thereof is suspended from the motor placing the cross bar 24 of each connecting member 22 in tension. Despite the region of weakness in each cross bar 24 created by each aperture 28, the connecting members 22 collectively have sufficient tensile strength to allow manoeuvring of the drill bit without premature separation of the two parts 4,6. In the event that the drill bit becomes jammed in such a way that retrieval of the drill string from a downhole position is prevented, uphole force may be applied to the drill string so as to increase tension within each cross bar 24 to the extent that each cross bar 24 breaks at its aperture 28. The first part 4 portion of drilling sting attached thereto may then be removed from the hole leaving only the drill bit and second part 6 (and cover sleeve 30) of the release joint 2. The drill bit and first part 4 may then be retrieved with specialist retrieval equipment.

Although the cross bar 24 of each connecting member is provided with weakening means in the form of an aperture 28, the release joint remains capable of transmitting high torque loads. This is possible by virtue of the support provided to the cross bar 24 by the sides of the associated axially projecting slot 20 provided in the second part 6. It will be understood that, when a motor applies torque to the second part 6 of the release joint 2, this torque is transmitted via the sides of the axially projecting slot 20 to a length of cross bar 24 remote to the aperture 28. In this way, the region of cross bar 24 provided with the aperture 28 is not subjected to undesirably high stress during torque transmission which may result in the cross bar 24 breaking. Torque is transmitted from the first part 4 to the second part 6 by means of a portion of cross bar 24 capable of withstanding the stresses involved.

The present invention is not limited to the specific embodiment described above. Alternative arrangements will be apparent to a reader skilled in the art. For example, in the release joint 2 of FIGS. 1 to 5, the end of the second part 6 distal to the internal screw thread 10 is provided with a GS external profile. Once the first part 4 has been removed from the wellbore with the remainder of the drill string, the GS profile may be latched onto a fishing tool. Since the GS profile is only suitable for transmitting axial forces to the second part 6 and drill bit, use of the first downhole release joint 2 is particularly suited to operations employing coil strings. However, in an alternative second embodiment as shown in FIGS. 6 to 10, a second downhole release joint 50 is shown wherein the second part 6 is provided with an external standard API thread profile rather than a GS profile. It should be noted that the first part 4 is not provided with a cooperating internal screw thread. Thus, once the first part 4 has been pulled from the second part 6 and pulled uphole, the jammed drill bit may be threadedly engaged with a fishing tool by virtue of the aforementioned API threaded pin-up projection. The connection provided by this threaded pin-up allows the transmission of torque to the jammed drill bit. Components of the second release joint 50 common with the first release joint 2 are identified in the accompanying drawings with like reference numerals.

In the embodiments shown, the connecting members 22 are arranged to break under between 60000 to 80000 LBS tension and 12000 FT LBS TYP torsion.

Further alternative arrangements will be apparent to the skilled reader.

The invention claimed is:

1. Downhole apparatus comprising a first part connected to a second part by connecting means, the connecting means limiting axial and rotational movement of the first part relative to the second part and comprising a connecting member having a first end connected to said first part so as to limit axial and rotational movement of said first part relative to said first end and having a second end connected to said second part so as to limit axial and rotational movement of said second part relative to said second end, wherein the connecting member is provided between said first and second ends with a region of weakness in the connecting member provided by weakening means, and with means for minimizing stress generated in the connecting means at said region of weakness when torque is transmitted in use between the first and second parts via the connecting member, the first and second parts being separable from each other by application of a pulling force on the first part while the second part is held stationary to break the connecting means at the region of weakness.

2. Downhole apparatus as claimed in claim 1, wherein the connecting member comprises an axially projecting portion extending from said first end to said second end.

3. Downhole apparatus as claimed in claim 2 wherein at least one of said ends of the connecting member is provided with hook means for hooking about one of said first and second parts so as to allow a transmission of tension between said one part and the connecting member.

4. Downhole apparatus as claimed in claim 3, wherein the hook means comprises a portion extending perpendicularly to the axially projecting portion.

5. Downhole apparatus as claimed in claim 4, wherein said perpendicularly extending portion extends circumferentially about the longitudinal axis of the apparatus.

6. Downhole apparatus as claimed in claim 5, wherein each end of said axially projecting portion of the connecting member is provided with hook means.

7. Downhole apparatus as claimed in claim 6, wherein the or each hook means is located adjacent a shoulder provided in one of the first and second parts.

8. Downhole apparatus as claimed in claim 7, wherein the connecting member is of an H-shape wherein the cross member of the H-shape is the axially projecting portion.

9. Downhole apparatus as claimed in claim 8, wherein the weakening means comprises a reduction in cross-sectional area of said axially projecting portion of the connecting member.

10. Downhole apparatus as claimed in claim 9, wherein the weakening means comprises an aperture provided in the axially projecting portion.

11. Downhole apparatus as claimed in claim 1, wherein the connecting means comprises a plurality of connecting members.

12. Downhole apparatus as claimed in claim 1, wherein the connecting means comprises four connecting members.

13. Downhole apparatus as claimed in claim 1, wherein said means for minimizing stress generated in the connecting member at said region of weakness comprises a shoulder defined by one of said parts, the shoulder comprising an axially extending surface for abutting the connecting member in said region of weakness during transmission of torque through said apparatus when in use.

14. Downhole apparatus as claimed in claim 13, wherein the axially extending surface of said shoulder abuts the connecting member in a region remote from the region of weakness.

* * * * *

UNITED STATES PATENT AND TRADEMARK OFFICE

CERTIFICATE OF CORRECTION

PATENT NO. : 7,198,101 B2
APPLICATION NO. : 10/484636
DATED : April 3, 2007
INVENTOR(S) : Mcgarian et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by (123) days Delete the phrase "by 123 days" and insert -- by 251 days --

Signed and Sealed this

Twenty-fifth Day of December, 2007

JON W. DUDAS
*Director of the United States Patent and Trademark Office*